US006301556B1

(12) United States Patent
Hagen et al.

(10) Patent No.: US 6,301,556 B1
(45) **Date of Patent: *Oct. 9, 2001**

(54) REDUCING SPARSENESS IN CODED SPEECH SIGNALS

(75) Inventors: Roar Hagen, Stockholm; Björn Stig Erik Johansson, Spånga; Erik Ekudden, Åkersberga; Willem Baastian Kleijn, Tullinge, all of (SE)

(73) Assignee: Telefonaktiebolaget L M. Ericsson (publ), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/470,472

(22) Filed: Dec. 22, 1999

Related U.S. Application Data

(63) Continuation of application No. 09/110,989, filed on Jul. 7, 1998, now Pat. No. 6,029,125, and a continuation-in-part of application No. 09/034,590, filed on Mar. 4, 1998.

(51) Int. Cl.[7] ..... G10L 19/00

(52) U.S. Cl. ..... 704/201; 704/267; 704/268

(58) Field of Search ..... 764/201, 219, 764/267, 268; 379/88.01

(56) References Cited

U.S. PATENT DOCUMENTS

| | | | | |
|---|---|---|---|---|
| 5,195,137 | * | 3/1993 | Swaminathan | 381/32 |
| 6,029,125 | * | 2/2000 | Hagen et al. | 704/201 |
| 6,058,359 | * | 5/2000 | Hagen et al. | 704/214 |

* cited by examiner

*Primary Examiner*—William Korzuch
*Assistant Examiner*—Susan McFadden
(74) *Attorney, Agent, or Firm*—Jenkens & Gilchrist, P.C.

(57) ABSTRACT

An apparatus and method for reducing sparseness in a coded speech signal. Sparse codebook values are generated from a codebook. An anti-sparseness operation is performed on the sparse codebook values to produce output codebook values having a greater density of non-zero values than the sparse codebook values. The output codebook values are processed by a speech processor to generate an encoded speech signal during an encoding operation or a decoded speech signal during a decoding operation.

68 Claims, 7 Drawing Sheets

4000Hz
2000
0
1
0.5
2
-2
-4
-0.5
-1
5
10
15
20
25
30
35
40
7

REDUCING SPARSENESS IN CODED SPEECH SIGNALS

This application is a continuation of parent application Ser. No. 09/110,989, filed Jul. 7, 1998 and now U.S. Pat. No. 6,029,125 issued Feb. 22, 2000. This parent application claims the priority under 35 USC 119(e) (1) of U.S. Provisional Application No. 06/057,752, filed on Sep. 2, 1997, and is a continuation-in-part of U.S. Ser. No. 09/034,590, filed on Mar. 4, 1998.

FIELD OF THE INVENTION

The invention relates generally to speech coding and, more particularly, to the problem of sparseness in coded speech signals.

BACKGROUND OF THE INVENTION

Speech coding is an important part of modern digital communications systems, for example, wireless radio communications systems such as digital cellular telecommunications systems. To achieve the high capacity required by such systems both today and in the future, it is imperative to provide efficient compression of speech signals while also providing high quality speech signals. In this connection, when the bit rate of a speech coder is decreased, for example to provide additional communication channel capacity for other communications signals, it is desirable to obtain a graceful degradation of speech quality without introducing annoying artifacts.

Conventional examples of lower rate speech coders for cellular telecommunications are illustrated in IS-641 (D-AMPS EFR) and by the G.729 ITU standard. The coders specified in the foregoing standards are similar in structure, both including an algebraic codebook that typically provides a relatively sparse output. Sparseness refers in general to the situation wherein only a few of the samples of a given codebook entry have a non-zero sample value. This sparseness condition is particularly prevalent when the bit rate of the algebraic codebook is reduced in an attempt to provide speech compression. With very few non-zero samples in the codebook to begin with, and with the lower bit rate requiring that even fewer codebook samples be used, the resulting sparseness is an easily perceived degradation in the coded speech signals of the aforementioned conventional speech coders.

It is therefore desirable to avoid the aforementioned degradation in coded speech signals when the bit rate of a speech coder is reduced to provide speech compression.

In an attempt to avoid the aforementioned degradation in coded speech signals, the present invention provides an anti-sparseness operator for reducing the sparseness in a coded speech signal, or any digital signal, wherein sparseness is disadvantageous.

DETAILED DESCRIPTION

Figure 1:
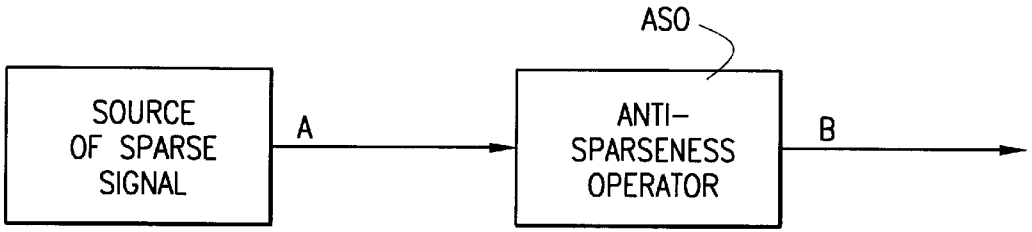
FIG. 1 is a block diagram which illustrates one example of an anti-sparseness operator of the present invention.

FIG. 1 illustrates an example of an anti-sparseness operator according to the present invention. The anti-sparseness operator ASO of FIG. 1 receives at input A thereof a sparse, digital signal received from a source 11. The anti-sparseness operator ASO operates on the sparse signal A and provides at an output thereof a digital signal B which is less sparse than the input signal A.

Figure 2:
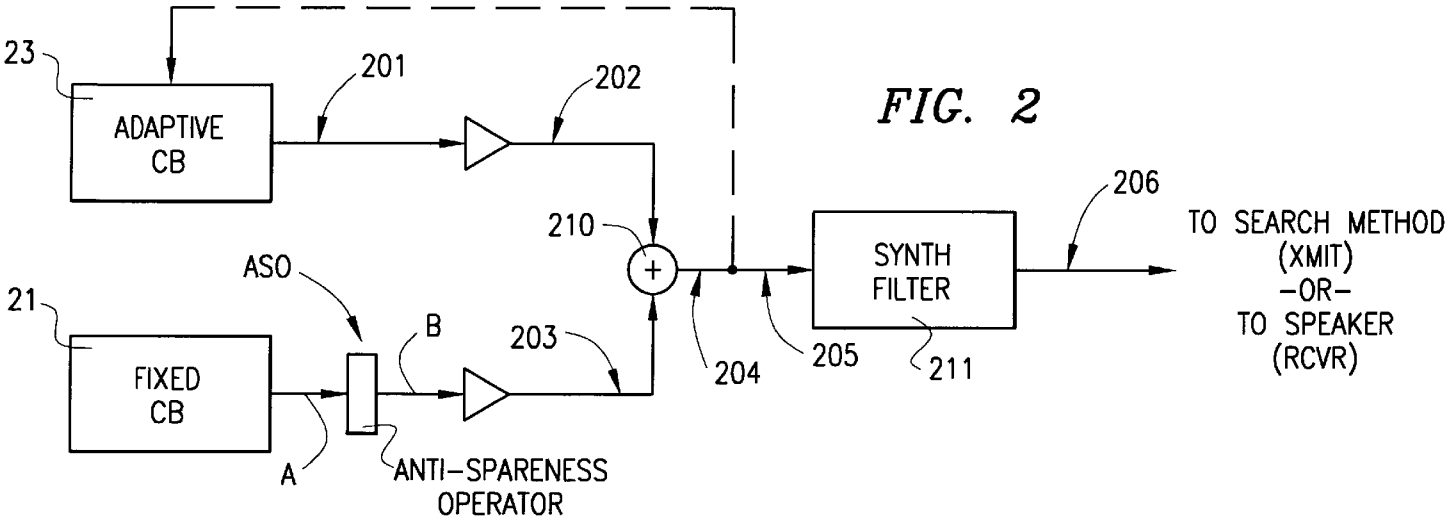
FIG. 2 illustrates various positions in a Code Excited Linear Predictive encoder/decoder where the anti-sparseness operator of FIG. 1 can be applied.

FIG. 2 illustrates various example locations where the anti-sparseness operator ASO of FIG. 1 can be applied in a Code Excited Linear Predictive (CELP) speech encoder provided in a transmitter for use in a wireless communication system, or in a CELP speech decoder provided in a receiver of a wireless communication system. As shown in FIG. 2, the anti-sparseness operator ASO can be provided at the output of the fixed (e.g., algebraic) codebook 21, and/or at any of the locations designated by reference numerals 201–206. At each of the locations designated in FIG. 2, the anti-sparseness operator ASO of FIG. 1 would receive at its input A the sparse signal and provide at its output B a less sparse signal. Thus, the CELP speech encoder/decoder structure shown in FIG. 2 includes several examples of the sparse signal source of FIG. 1.

The broken line in FIG. 2 illustrates the conventional feedback path to the adaptive codebook as conventionally provided in CELP speech encoders/decoders. If the anti-sparseness operator ASO is provided where shown in FIG. 2 and/or at any of locations 201–204, then the anti-sparseness operator(s) will affect the coded excitation signal reconstructed by the decoder at the output of summing circuit 210. If applied at locations 205 and/or 206, the anti-sparseness operator(s) will have no effect on the coded excitation signal output from summing circuit 210.

Figure 2A:
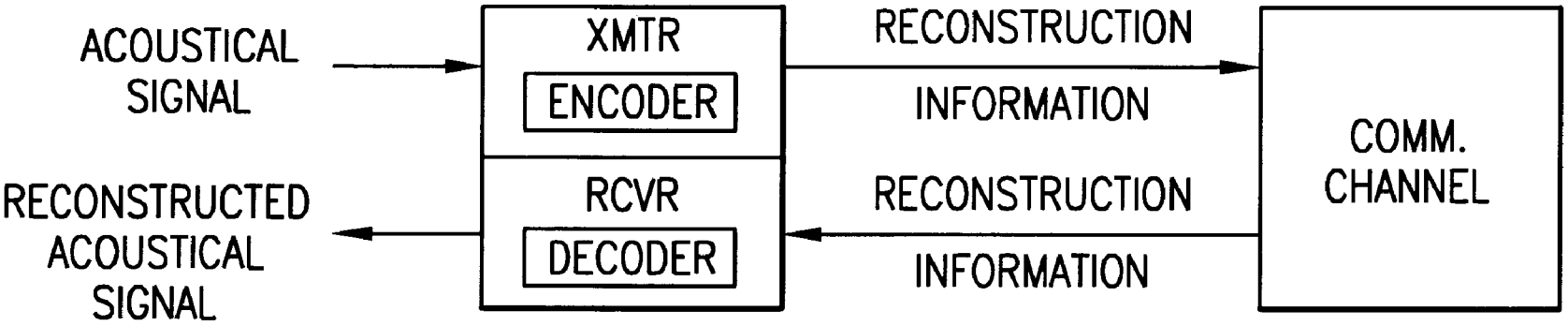
FIG. 2A illustrates a communications transceiver that can use the encoder/decoder structure of FIGS. 2 and 2B.
Figure 2B:
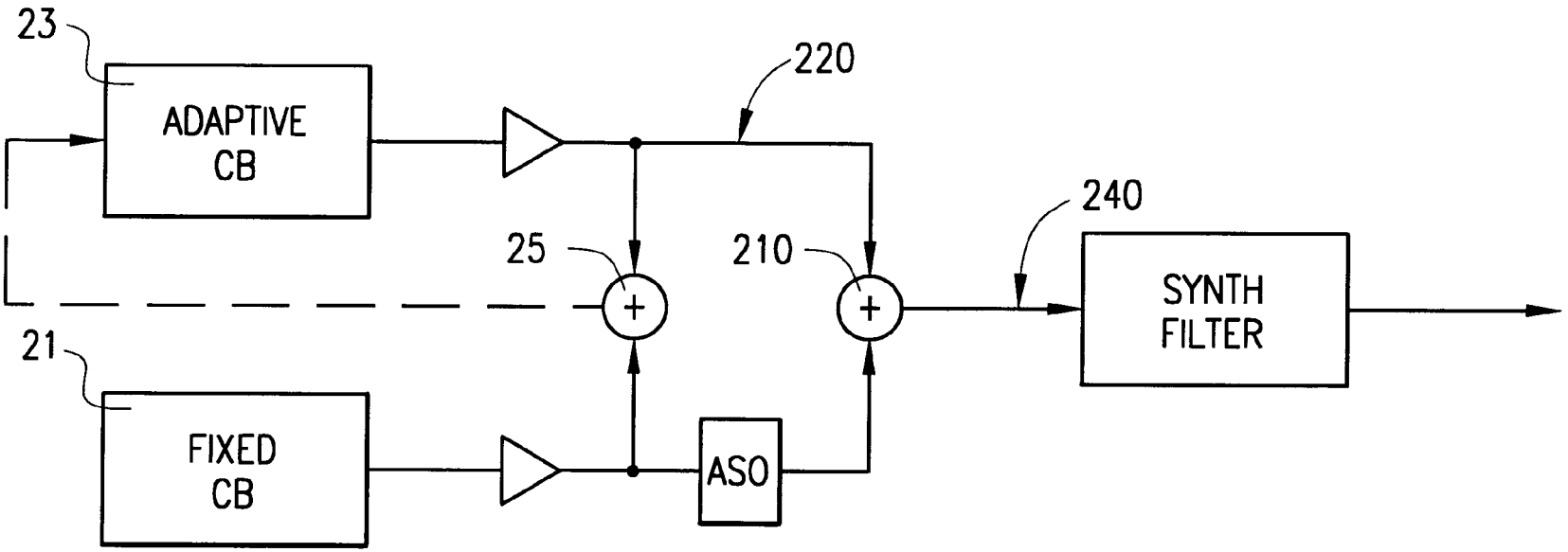
FIG. 2B illustrates another exemplary Code Excited Linear Predictive decoder including the anti-sparseness operator of FIG. 1.

FIG. 2B illustrates an example CELP decoder including a further summing circuit 25 which receives the outputs of codebooks 21 and 23, and provides the feedback signal to the adaptive codebook 23. If the anti-sparseness operator ASO is provided where shown in FIG. 2B, and/or at locations 220 and 240, then such anti-sparseness operator(s) will not affect the feedback signal to the adaptive codebook 23.

FIG. 2A illustrates a transceiver whose receiver (RCVR) includes the CELP decoder structure of FIG. 2 (or FIG. 2B) and whose transmitter (XMTR) includes the CELP encoder structure of FIG. 2. FIG. 2A illustrates that the transmitter receives as input an acoustical signal and provides as output to the communications channel reconstruction information from which a receiver can reconstruct the acoustical signal. The receiver receives as input from the communications channel reconstruction information, and provides a reconstructed acoustical signal as an output. The illustrated transceiver and communications channel could be, for example, a transceiver in a cellular telephone and the air interface of a cellular telephone network, respectively.

Figure 4:
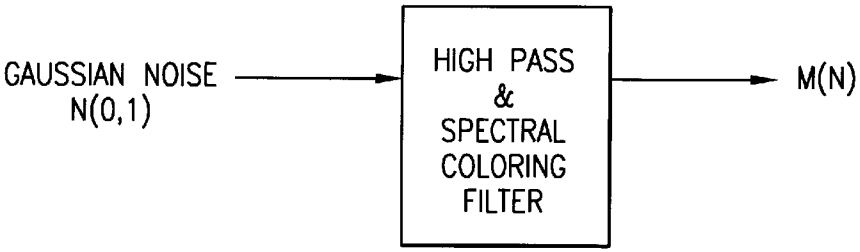
FIG. 4 illustrates one example of how the additive signal of FIG. 3 can be produced.
Figure 3:
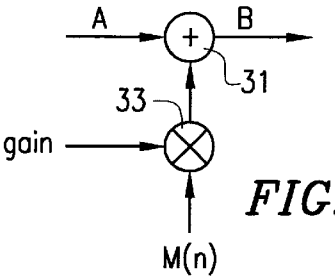
FIG. 3 illustrates one example of the anti-sparseness operator of FIG. 1.

FIG. 3 illustrates one example implementation of the anti-sparseness operator ASO of FIG. 1. In FIG. 3, a noise-like signal m(n) is added to the sparse signal as received at A. FIG. 4 illustrates one example of how the signal m(n) can be produced. A noise signal with a Gaussian distribution N(0,1) is filtered by a suitable high pass and spectral coloring filter to produce the noise-like signal m(n).

As illustrated in FIG. 3, the signal m(n) can be applied to the summing circuit 31 with a suitable gain factor via multiplier 33. The gain factor of FIG. 3 can be a fixed gain factor. The gain factor of FIG. 3 can also be a function of the gain conventionally applied to the output of adaptive codebook 23 (or a similar parameter describing the amount of periodicity). In one example, the FIG. 3 gain would be 0 if the adaptive codebook gain exceeds a predetermined threshold, and linearly increasing as the adaptive codebook gain decreases from the threshold. The FIG. 3 gain can also be analogously implemented as a function of the gain conventionally applied to the output of the fixed codebook 21 of FIG. 2. The FIG. 3 gain can also be based on power-spectrum matching of the signal m(n) to the target signal used in the conventional search method, in which case the gain needs to be encoded and transmitted to the receiver.

In another example, the addition of a noise-like signal can be performed in the frequency domain in order to obtain the benefit of advanced frequency domain analysis.

Figure 5:
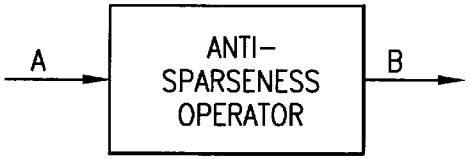
FIG. 5 illustrates in block diagram form how the anti-sparseness operator of FIG. 1 can be embodied as an anti-sparseness filter.

FIG. 5 illustrates another example implementation of the ASO of FIG. 2. The arrangement of FIG. 5 can be characterized as an anti-sparseness filter designed to reduce sparseness in the digital signal received from the source 11 of FIG. 1.

Figure 6:
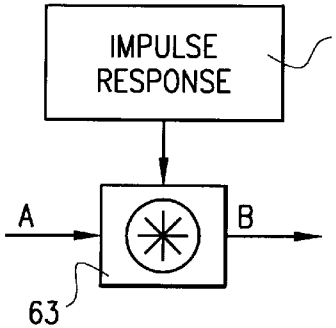
FIG. 6 illustrates one example of the anti-sparseness filter of FIG. 5.

One example of the anti sparseness filter of FIG. 5 is illustrated in more detail in FIG. 6. The anti-sparseness filter of FIG. 6 includes a convolver section 63 that performs a convolution of the coded signal received from the fixed (e.g. algebraic) codebook 21 with an impulse response (at 65) associated with an all-pass filter. The operation of one example of the FIG. 6 anti-sparseness filter is illustrated in FIGS. 7–11.

Figures 7, 8, 9, 10, 11:
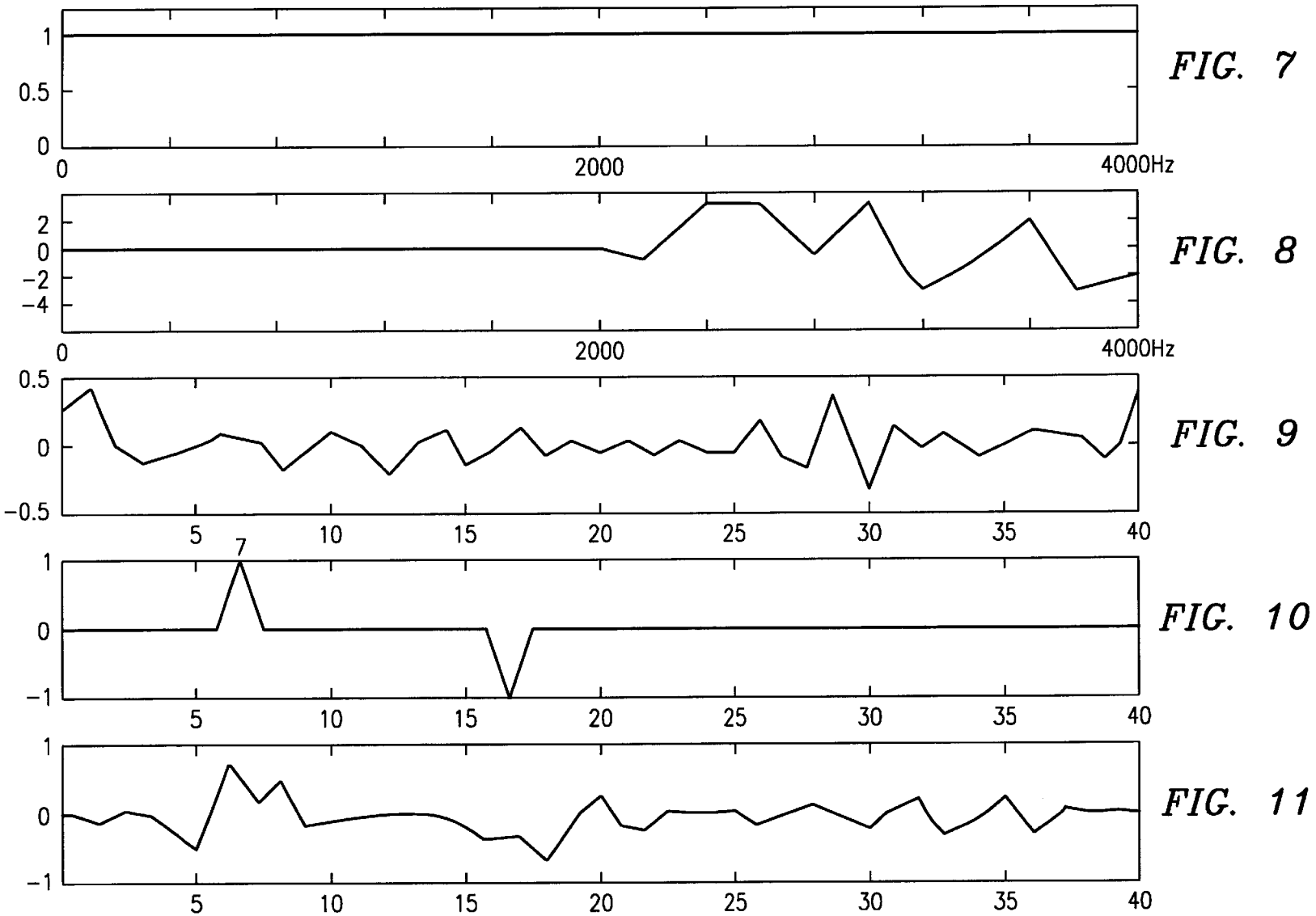
FIGS. 7–11 illustrate graphically the operation of an anti-sparseness filter of the type illustrated in FIG. 6.
Figure 12:
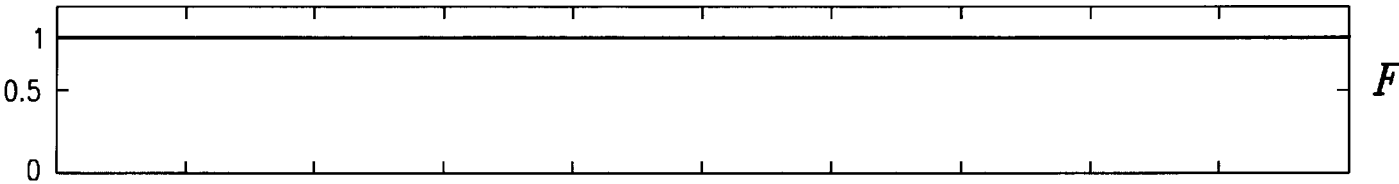
FIGS. 12–16 illustrate graphically the operation of an anti-sparseness filter of the type illustrated in FIG. 6 and at a relatively lower level of anti-sparseness operation than the anti-sparseness filter of FIGS. 7–11.
Figure 13:
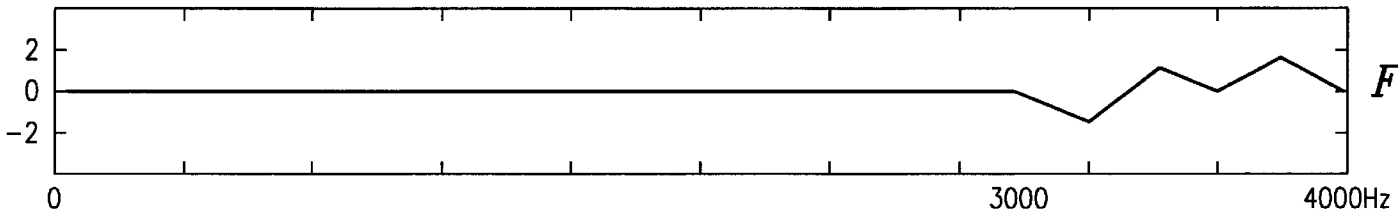

FIG. 10 illustrates an example of an entry from the codebook 21 of FIG. 2 having only two non-zero samples out of a total of forty samples. This sparseness characteristic will be reduced if the number (density) of non-zero samples can be increased. One way to increase the number of non-zero samples is to apply the codebook entry of FIG. 10 to a filter having a suitable characteristic to disperse the energy throughout the block of forty samples. FIGS. 7 and 8 respectively illustrate the magnitude and phase (in radians) characteristics of an all-pass filter which is operable to appropriately disperse the energy throughout the forty samples of the FIG. 10 codebook entry. The filter of FIGS. 7 and 8 alters the phase spectrum in the high frequency area between 2 and 4 kHz, while altering the low frequency areas below 2 kHz only very marginally. The magnitude spectrum remains essentially unaltered by the filter of FIGS. 7 and 8.

Example FIG. 9 illustrates graphically the impulse response of the all-pass filter defined by FIGS. 7 and 8. The anti-sparseness filter of FIG. 6 produces a convolution of the FIG. 9 impulse response on the FIG. 10 block of samples. Because the codebook entries are provided from the codebook as blocks of forty samples, the convolution operation is performed in blockwise fashion. Each sample in FIG. 10 will produce 40 intermediate multiplication results in the convolution operation. Taking the sample at position 7 in FIG. 10 as an example, the first 34 multiplication results are assigned to positions 7–40 of the FIG. 11 result block, and the remaining 6 multiplication results are "wrapped around" according to a circular convolution operation such that they are assigned to positions 1–6 of the result block. The 40 intermediate multiplication results produced by each of the remaining FIG. 10 samples are assigned to positions in the FIG. 11 result block in analogous fashion, and sample 1 of course needs no wrap around. For each position in the result block of FIG. 11, the 40 intermediate multiplication results assigned thereto (one multiplication result per sample in FIG. 10) are summed together, and that sum represents the convolution result for that position.

It is clear from inspection of FIGS. 10 and 11 that the circular convolution operation alters the Fourier spectrum of the FIG. 10 block so that the energy is dispersed throughout the block, thereby dramatically increasing the number (or density) of non-zero samples in the block, and correspondingly reducing the amount of sparseness. The effects of performing the circular convolution on a block-by-block basis can be smoothed out by the synthesis filter 211 of FIG. 2.

Figure 14:
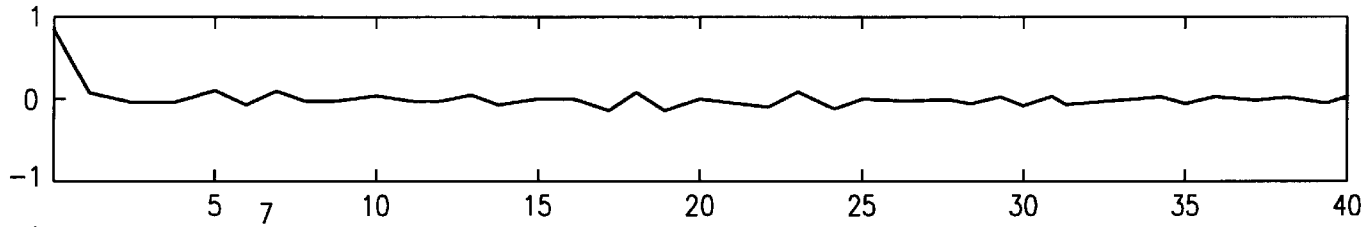
Figure 15:
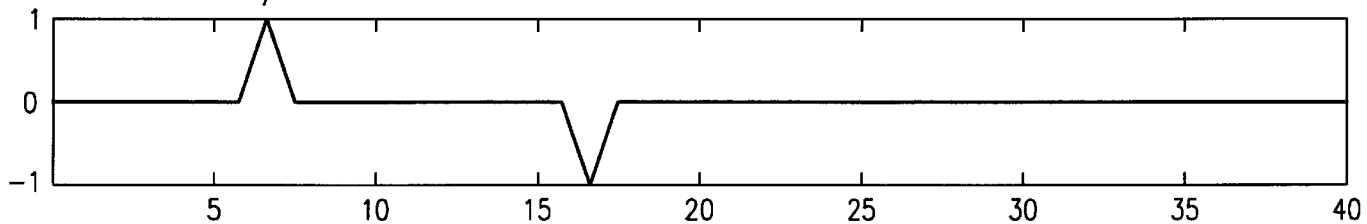
Figure 16:
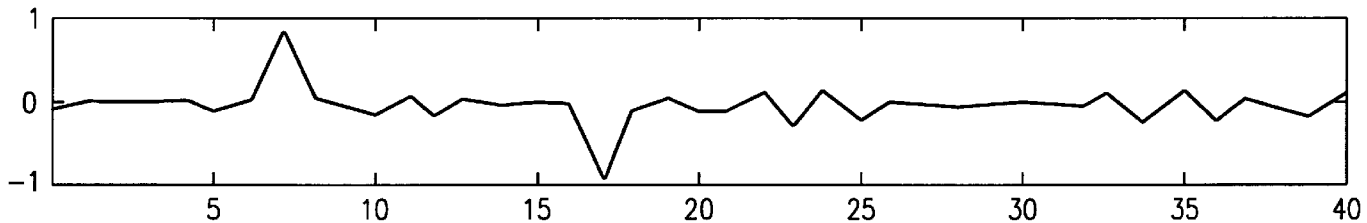

FIGS. 12–16 illustrate another example of the operation of an anti-sparseness filter of the type shown generally in FIG. 6. The all-pass filter of FIGS. 12 and 13 alters the phase spectrum between 3 and 4 kHz without substantially altering the phase spectrum below 3 kHz. The impulse response of the filter is shown in FIG. 14. Referencing the result block of FIG. 16, and noting that FIG. 15 illustrates the same block of samples as FIG. 10, it is clear that the anti-sparseness operation illustrated in FIGS. 12–16 does not disperse the energy as much as shown in FIG. 11. Thus, FIGS. 12–16 define an anti-sparseness filter which modifies the codebook entry less than the filter defined by FIGS. 7–11. Accordingly, the filters of FIGS. 7–11 and FIGS. 12–16 define respectively different levels of anti-sparseness filtering.

A low adaptive codebook gain value indicates that the adaptive codebook component of the reconstructed excitation signal (output from adder circuit 210) will be relatively small, thus giving rise to the possibility of a relatively large contribution from the fixed (e.g. algebraic) codebook 21. Because of the aforementioned sparseness of the fixed codebook entries, it would be advantageous to select the anti-sparseness filter of FIGS. 7–11 rather than that of FIGS. 12–16 because the filter of FIGS. 7–11 provides a greater modification of the sample block than does the filter of FIGS. 12–16. With larger values of adaptive codebook gain, the fixed codebook contribution is relatively less, so the filter of FIGS. 12–16 which provides less anti-sparseness modification could be used.

The present invention thus provides the capability of using the local characteristics of a given speech segment to determine whether and how much to modify the sparseness characteristic associated with that segment.

The convolution performed in the FIG. 6 anti-sparseness filter can also be linear convolution, which provides smoother operation because blockwise processing effects are avoided. Moreover, although blockwise processing is described in the above examples, such blockwise processing is not required to practice the invention, but rather is merely a characteristic of the conventional CELP speech encoder/decoder structure shown in the examples.

A closed-loop version of the method can be used. In this case, the encoder takes the anti-sparseness modification into account during search of the codebooks. This will give improved performance at the price of increased complexity. The (circular or linear) convolution operation can be implemented by multiplying the filtering matrix constructed from the conventional impulse response of the search filter by a matrix which defines the anti-sparseness filter (using either linear or circular convolution).

Figure 17:
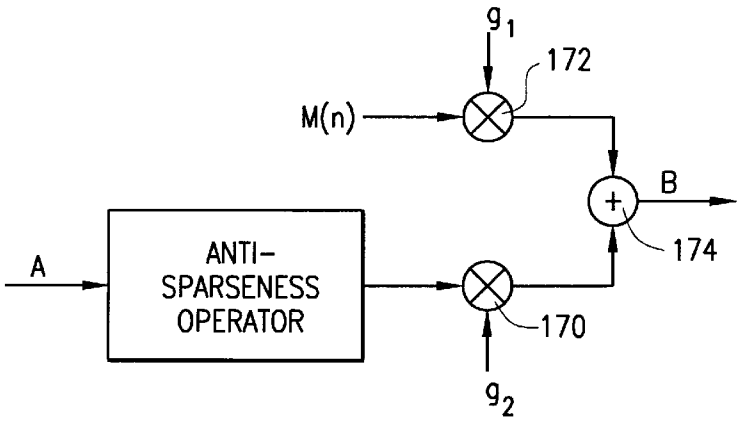
FIG. 17 illustrates another example of the anti-sparseness operator of FIG. 1.

FIG. 17 illustrates another example of the anti-sparseness operator ASO of FIG. 1. In the example of FIG. 17, an anti-sparseness filter of the type illustrated in FIG. 5 receives input signal A, and the output of the anti-sparseness filter is multiplied at 170 by a gain factor $g_2$. The noise-like signal m(n) from FIGS. 3 and 4 is multiplied at 172 by a gain factor $g_1$, and the outputs of the $g_1$ and $g_2$ multipliers 170 and 172 are added together at 174 to produce output signal B. The gain factors $g_1$ and $g_2$ can be determined, for example, as follows. The gain $g_1$ can first be determined in one of the ways described above with respect to the gain of FIG. 3, and then the gain factor $g_2$ can be determined as a function of gain factor $g_1$. For example, gain factor $g_2$ can vary inversely with gain factor $g_1$. Alternatively, the gain factor $g_2$ can be determined in the same manner as the gain of FIG. 3, and then the gain factor $g_1$ can be determined as a function of gain factor $g_2$, for example $g_1$ can vary inversely with $g_2$.

In one example of the FIG. 17 arrangement: the anti-sparseness filter of FIGS. 12–16 is used; gain factor $g_2$=1; m(n) is obtained by normalizing the Gaussian noise distribution N(0,1) of FIG. 4 to have an energy level equal to the fixed codebook entries, and setting the cutoff frequency of the FIG. 4 high pass filter at 200 Hz; and gain factor $g_1$ is 80% of the fixed codebook gain.

Figure 18:
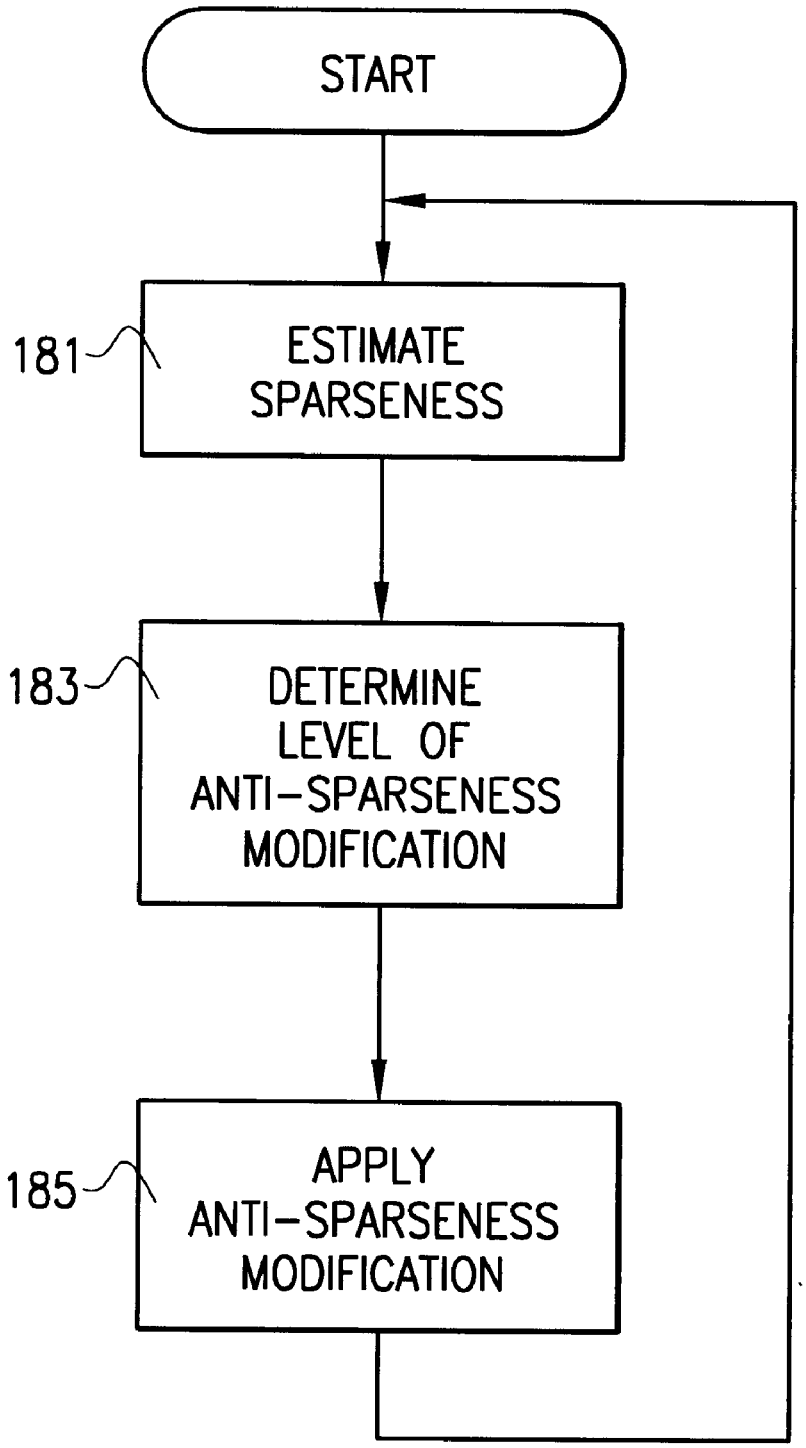
FIG. 18 illustrates an exemplary method of providing anti-sparseness modification according to the invention.

FIG. 18 illustrates an exemplary method of providing anti-sparseness modification according to the invention. At 181, the level of sparseness of the coded speech signal is estimated. This can be done off-line or adaptively during speech processing. For example, in algebraic codebooks and multi-pulse codebooks the samples may be close to each other or far apart, resulting in varying sparseness; whereas in a regular pulse codebook, the distance between samples is fixed, so the sparseness is constant. At 183, a suitable level of anti-sparseness modification is determined. This step can also be performed off-line or adaptively during speech processing as described above. As another example of adaptively determining the anti-sparseness level, the impulse response (see FIGS. 6, 9 and 14) can be changed from block to block. At 185, the selected level of anti-sparseness modification is applied to the signal.

It will be evident to workers in the art that the embodiments described above with respect to FIGS. 1–18 can be readily implemented using, for example, a suitably programmed digital signal processor or other data processor, and can alternatively be implemented using, for example, such suitably programmed digital signal processor or other data processor in combination with additional external circuitry connected thereto.

Although exemplary embodiments of the present invention have been described above in detail, this does not limit the scope of the invention, which can be practiced in a variety of embodiments.

What is claimed is:

1. An apparatus for reducing sparseness in a coded speech signal, said apparatus comprising:

a codebook for producing sparse codebook values;

an anti-sparseness operator coupled to said codebook for receiving said sparse codebook values and producing output codebook values having a greater density of non-zero values than said sparse codebook values; and a speech processing device receiving said output codebook values and generating a digital speech signal, whereby said digital speech signal is an encoded speech signal during an encoding operation by said speech processing device, or said digital speech signal is a decoded speech signal during a decoding operation by said speech processing device.

2. The apparatus of claim 1, wherein said anti-sparseness operator includes a circuit for adding a noise-like signal to said sparse codebook values.

3. The apparatus of claim 2, wherein said noise-like signal is generated from a signal having a Gaussian distribution filtered by a high pass and spectral coloring filter.

4. The apparatus of claim 2, wherein said noise-like signal is multiplied by a gain factor prior to being added to said sparse codebook values.

5. The apparatus of claim 4, wherein said gain factor is a fixed value.

6. The apparatus of claim 4, wherein said gain factor is a function of a gain applied to the output of an adaptive codebook.

7. The apparatus of claim 4, wherein said gain factor is a function of a gain applied to the output of a fixed codebook.

8. The apparatus of claim 1, wherein said anti-sparseness operator includes a filter coupled to said codebook to filter said sparse codebook values.

9. The apparatus of claim 8, wherein said filter is an all-pass filter.

10. The apparatus of claim 8, wherein said filter performs a circular convolution to filter said sparse codebook values.

11. The apparatus of claim 8, wherein said filter performs a linear convolution to filter said sparse codebook values.

12. The apparatus of claim 8, wherein said filter modifies a phase spectrum of said sparse codebook values but leaves a magnitude spectrum thereof substantially unaltered.

13. The apparatus of claim 8, wherein the output of said filter is multiplied by a gain factor.

14. The apparatus of claim 8, wherein a noise-like signal is added to the output of said filter.

15. The apparatus of claim 8, wherein the output of said filter is multiplied by a first gain factor and added to a noise-like signal multiplied by a second gain factor.

16. The apparatus of claim 15, wherein said first gain factor is a function of said second gain factor.

17. The apparatus of claim 15, wherein said second gain factor is a function of said first gain factor.

18. The apparatus of claim 15, wherein said first gain factor varies inversely with said second gain factor.

19. The apparatus of claim 1, wherein said speech processing device is a speech encoder.

20. The apparatus of claim 19, wherein said speech encoder is a code excited linear predictive (CELP) speech encoder.

21. The apparatus of claim 19, wherein said apparatus is part of a transmitter.

22. The apparatus of claim 19, wherein said apparatus is part of a receiver.

23. The apparatus of claim 1, wherein said speech processing device is a speech decoder.

24. The apparatus of claim 23, wherein said speech decoder is a code excited linear predictive (CELP) speech decoder.

25. The apparatus of claim 23, wherein said apparatus is part of a transmitter.

26. The apparatus of claim 23, wherein said apparatus is part of a receiver.

27. The apparatus of claim 1, wherein said codebook is a fixed codebook.

28. The apparatus of claim 1, wherein said codebook is an adaptive codebook.

29. The apparatus of claim 1, further comprising:

an adaptive codebook providing an output which is summed with said output codebook values before being input into said speech processing device.

30. The apparatus of claim 29, wherein said codebook is a fixed codebook.

31. A method for reducing sparseness in a coded speech signal, said method comprising the steps of:

generating sparse codebook values using a codebook;

performing an anti-sparseness operation on said sparse codebook values to produce output codebook values having a greater density of non-zero values than said sparse codebook values; and processing said output codebook values using a speech processing device to generate a digital speech signal, whereby said digital speech signal is an encoded speech signal during an encoding operation by said speech processing device, or said digital speech signal is a decoded speech signal during a decoding operation by said speech processing device.

32. The method of claim 31, wherein said anti-sparseness operation includes adding a noise-like signal to said sparse codebook values.

33. The method of claim 32, wherein said noise-like signal is generated from a signal having a Gaussian distribution filtered by a high pass and spectral coloring filter.

34. The method of claim 33, wherein said noise-like signal is multiplied by a gain factor prior to being added to said sparse codebook values.

35. The method of claim 34, wherein said gain factor is a fixed value.

36. The method of claim 34, wherein said gain factor is a function of a gain applied to the output of an adaptive codebook.

37. The method of claim 34, wherein said gain factor is a function of a gain applied to the output of a fixed codebook.

38. The method of claim 31, wherein said anti-sparseness operation includes filtering said sparse codebook values using a filter.

39. The method of claim 38, wherein said filter is an all-pass filter.

40. The method of claim 38, wherein said filter performs a circular convolution to filter said sparse codebook values.

41. The method of claim 38, wherein said filter performs a linear convolution to filter said sparse codebook values.

42. The method of claim 38, wherein said filter modifies a phase spectrum of said sparse codebook values but leaves a magnitude spectrum thereof substantially unaltered.

43. The method of claim 38, wherein the output of said filter is multiplied by a gain factor.

44. The method of claim 38, wherein a noise-like signal is added to the output of said filter.

45. The method of claim 38, wherein the output of said filter is multiplied by a first gain factor and added to a noise-like signal multiplied by a second gain factor.

46. The method of claim 45, wherein said first gain factor is a function of said second gain factor.

47. The method of claim 45, wherein said second gain factor is a function of said first gain factor.

48. The method of claim 45, wherein said first gain factor varies inversely with said second gain factor.

49. The method of claim 38, wherein the anti-sparseness properties of said filter are determined based upon the characteristics of a given speech segment.

50. A method for reducing sparseness in a coded speech signal, said method comprising the steps of:

estimating the level of sparseness of a coded speech signal;

determining a suitable level of anti-sparseness modification to said coded speech signal;

applying the determined suitable level of anti-sparseness to said coded speech signal to generate a modified coded speech signal; and providing said modified coded speech signal to a speech processing device to generate a digital speech signal, whereby said digital speech signal is an encoded speech signal during an encoding operation by said speech processing device, or said digital speech signal is a decoded speech signal during a decoding operation by said speech processing device.

51. The method of claim 50, wherein the determining step is performed off-line.

52. The method of claim 50, wherein the determining step is performed adaptively during speech processing.

53. A cellular telephone for use in a communication system, said cellular telephone comprising:

a codebook for producing sparse codebook values;

an anti-sparseness operator coupled to said codebook for receiving said sparse codebook values and producing output codebook values having a greater density of non-zero values than said sparse codebook values;

a speech processing device receiving said output codebook values and generating a digital speech signal, whereby said digital speech signal is an encoded speech signal during an encoding operation by said speech processing device, or said digital speech signal is a decoded speech signal during a decoding operation by said speech processing device.

54. The cellular telephone of claim 53, wherein said anti-sparseness operator includes a circuit for adding a noise-like signal to said sparse codebook values.

55. The cellular telephone of claim 54, wherein said noise-like signal is generated from a signal having a Gaussian distribution filtered by a high pass and spectral coloring filter.

56. The cellular telephone of claim 54, wherein said noise-like signal is multiplied by a gain factor prior to being added to said sparse codebook values.

57. The cellular telephone of claim 53, wherein said anti-sparseness operator includes a filter coupled to said codebook to filter said sparse codebook values.

58. The cellular telephone of claim 57, wherein said filter modifies a phase spectrum of said sparse codebook values but leaves a magnitude spectrum thereof substantially unaltered.

59. The cellular telephone of claim 57, wherein the output of said filter is multiplied by a gain factor.

60. The cellular telephone of claim 57, wherein a noise-like signal is added to the output of said filter.

61. The cellular telephone of claim 57, wherein the output of said filter is multiplied by a first gain factor and added to a noise-like signal multiplied by a second gain factor.

62. The cellular telephone of claim 53, wherein said speech processing device is a speech encoder.

63. The cellular telephone of claim 62, wherein said speech encoder is a code excited linear predictive (CELP) speech encoder.

64. The cellular telephone of claim 53, wherein said speech processing device is a speech decoder.

65. The cellular telephone of claim 64, wherein said speech decoder is a code excited linear predictive (CELP) speech decoder.

66. The cellular telephone of claim 53, wherein said codebook is a fixed codebook.

67. The cellular telephone of claim 53, wherein said codebook is an adaptive codebook.

68. The cellular telephone of claim 53, further comprising:

an adaptive codebook providing an output which is summed with said output codebook values before being input into said speech processing device.

* * * * *